US006889725B2

(12) United States Patent
Schultz et al.

(10) Patent No.: US 6,889,725 B2
(45) Date of Patent: May 10, 2005

(54) CONTAINER STRENGTHENING SYSTEM

(75) Inventors: Robert H. Schultz, Golden, CO (US); Christopher S. Derks, Arvada, CO (US); Elizabeth J. Sandidge, Arvada, CO (US)

(73) Assignee: Coors Global Properties, Inc., Lakewood, CO (US)

( * ) Notice: Subject to any disclaimer, the term of this patent is extended or adjusted under 35 U.S.C. 154(b) by 0 days.

(21) Appl. No.: 10/849,712

(22) Filed: May 19, 2004

(65) Prior Publication Data

US 2004/0261893 A1 Dec. 30, 2004

Related U.S. Application Data

(63) Continuation-in-part of application No. 10/678,851, filed on Oct. 3, 2003, now Pat. No. 6,763,858, which is a continuation of application No. 10/329,168, filed on Dec. 24, 2002, now Pat. No. 6,659,144, which is a continuation of application No. 09/812,640, filed on Mar. 20, 2001, now Pat. No. 6,378,571.

(51) Int. Cl.[7] ..... B65B 31/00

(52) U.S. Cl. ..... 141/70; 141/5; 141/63; 141/82; 141/92; 141/199

(58) Field of Search ..... 141/4–9, 11, 12, 141/47–50, 63–66, 69, 70, 82, 89, 91, 92, 156, 157, 159–161, 198–201, 205

(56) References Cited

U.S. PATENT DOCUMENTS

| | | | | | |
|---|---|---|---|---|---|
| 4,347,695 | A | * | 9/1982 | Zobel et al. | 53/432 |
| 4,407,340 | A | * | 10/1983 | Jensen et al. | 141/67 |
| 4,499,931 | A | * | 2/1985 | Urban | 141/67 |
| 4,588,000 | A | * | 5/1986 | Malin et al. | 141/1 |
| 6,378,571 | B1 | * | 4/2002 | Schultz et al. | 141/70 |
| 6,505,656 | B2 | * | 1/2003 | Schultz et al. | 141/70 |
| 6,659,144 | B2 | * | 12/2003 | Schultz et al. | 141/70 |
| 6,763,858 | B2 | * | 7/2004 | Schultz et al. | 141/70 |

* cited by examiner

*Primary Examiner*—Gregory L. Huson
*Assistant Examiner*—Peter deVore
(74) *Attorney, Agent, or Firm*—Klaas, Law, O'Meara & Malkin, P.C.; William P. O'Meara; Nellie C. Kaufman

(57) ABSTRACT

A system for strengthening containers in a high-speed filling operation is disclosed. The system includes a solenoid-driven injector apparatus positioned at an angle to the containers being filled. The injector apparatus includes a chamber connected via an intake line to a supply tank. A solenoid is adapted to open an injector valve, allowing liquefied gas within a chamber to forcibly flow through an outflow line into the container. The solenoid is also adapted to close the injector valve, thereby blocking the liquefied gas within the chamber from entering the outflow line. The injector apparatus also includes a heater positioned adjacent to the outflow line and an adjustment device for the injector valve.

18 Claims, 16 Drawing Sheets

CONTAINER STRENGTHENING SYSTEM

CROSS-REFERENCE TO RELATED APPLICATIONS

The present application is a continuation-in-part of U.S. patent application Ser. No. 10/678,851 filed Oct. 3, 2003 for CONTAINER STRENGTHENING SYSTEM of Robert H. Schultz et al., now U.S. Pat. No. 6,763,858, which is a continuation of U.S. patent application Ser. No. 10/329,168 filed Dec. 24, 2002 (now U.S. Pat. No. 6,659,144), which is a continuation of U.S. patent application Ser. No. 09/812,640 filed Mar. 20, 2001 (now U.S. Pat. No. 6,378,571), all of which are hereby specifically incorporated by reference for all that is disclosed therein.

FIELD OF THE INVENTION

The present invention relates generally to container strengthening systems, and, in particular, to liquefied gas injection systems used to strengthen containers.

BACKGROUND OF THE INVENTION

Carbonated beverages, such as soft drinks and beer, are commonly packaged in metallic containers such as aluminum cans. The carbonation within the beverage exerts pressure on the containers, thereby increasing the strength of the container walls. However, it is generally desirable to further strengthen the containers in order to decrease the likelihood of damage to the containers as well as minimize the necessary thickness of the container walls.

One method used for strengthening containers is to deposit a liquefied gas such as nitrogen onto the beverage immediately prior to sealing the container. After sealing, the evaporated liquefied gas creates pressure within the container and also displaces oxygen from the headspace, thereby helping to prevent spoilage of the beverage. Many devices used to accomplish this result simply lay the liquefied gas onto the surface of the beverage, rather than forcibly injecting the liquefied gas into the beverage. This may suffice for non-carbonated beverages as well as some carbonated beverages. However, with a carbonated beverage such as beer that tends to produce a frothy head upon filling the container, liquefied gas deposited within the container tends to roll off the frothy head of the beverage and out of the container.

One solution would be to forcibly inject a liquefied gas such as nitrogen into the beverage utilizing a high-performance, quick-responding solenoid. However, due to the extremely cold temperatures involved in utilizing liquefied gas, a solenoid-controlled injector system must be carefully designed to avoid atomization of the liquid, which may occur when the liquefied gas is not properly passed through various inlets and/or outlets within the system. Furthermore, the pressure within the system must be carefully controlled in order to deliver a consistent amount of liquid nitrogen to each container in a high-speed filling operation.

SUMMARY OF THE INVENTION

The present invention is directed to a system for strengthening containers in a high-speed filling operation. The system may include a solenoid-driven injector apparatus positioned at an angle to the containers being filled. The injector apparatus may comprise an intake line in fluid flow relation with the supply tank, and a chamber in fluid flow relation with the intake line. The injector apparatus may also comprise an injector valve located within the chamber which includes a needle stem, a valve seat within a valve body, and a substantially straight outflow line which leads to the containers being filled. An adjustment device may also be provided for adjusting the position of the valve seat relative to the needle stem. The injector apparatus may further comprise a solenoid operatively connected to the needle stem, and a biasing device biasing the needle stem toward the valve seat. A heater may also be provided adjacent to the outflow line. The injector apparatus has an open operating state whereby the needle stem is positioned away from the valve seat, allowing liquefied gas within the chamber to flow out of the outflow line and into one of the containers. The injector apparatus also has a closed operating state whereby the needle stem is seated within the valve seat, blocking the liquefied gas within the chamber from entering the outflow line.

BRIEF DESCRIPTION OF THE DRAWINGS

Illustrative and presently preferred embodiments of the invention are illustrated in the drawings in which.

DESCRIPTION OF THE PREFERRED EMBODIMENTS

Figure 1:
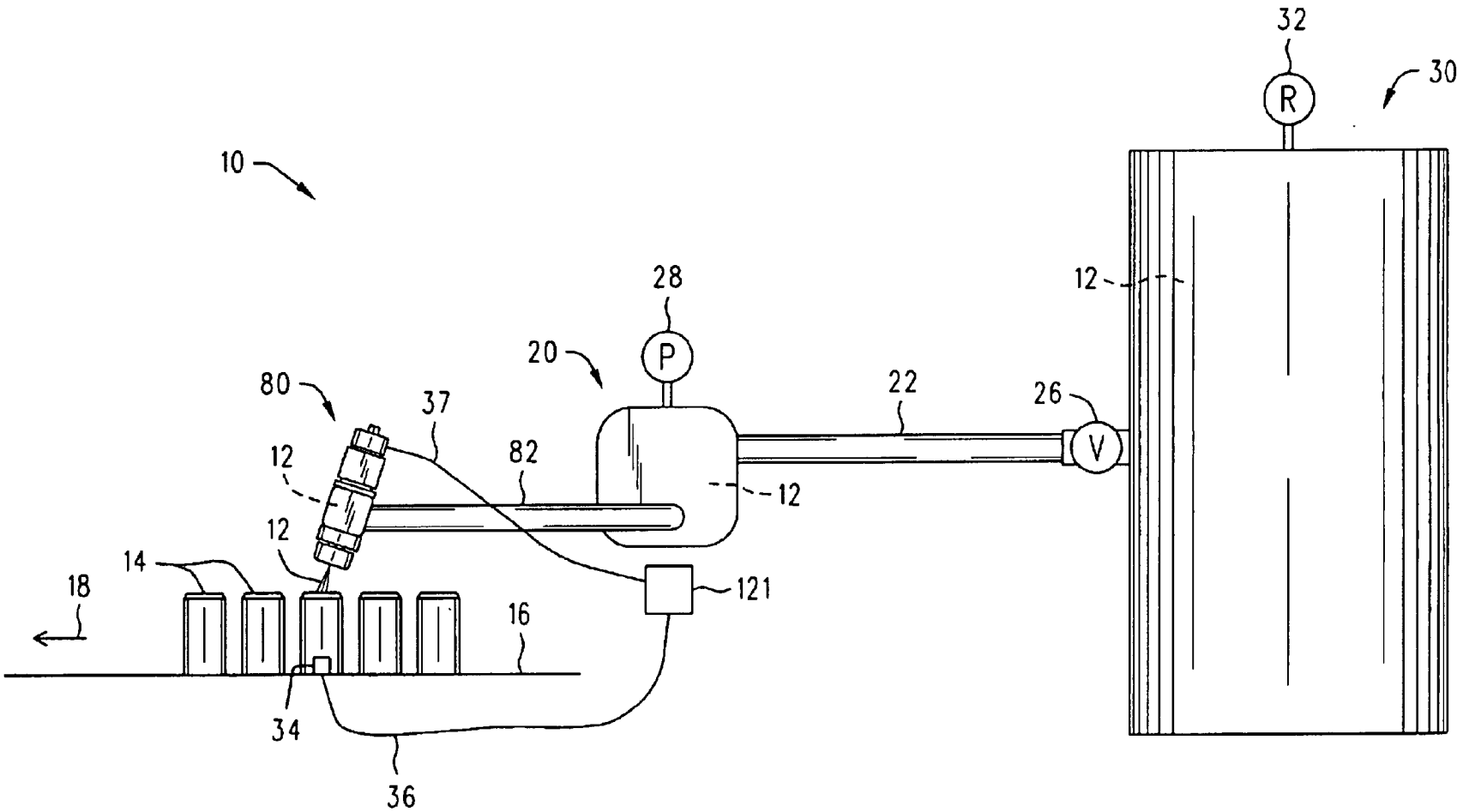
FIG. 1 is a front view of an exemplary container strengthening system of the present invention.
Figure 2:
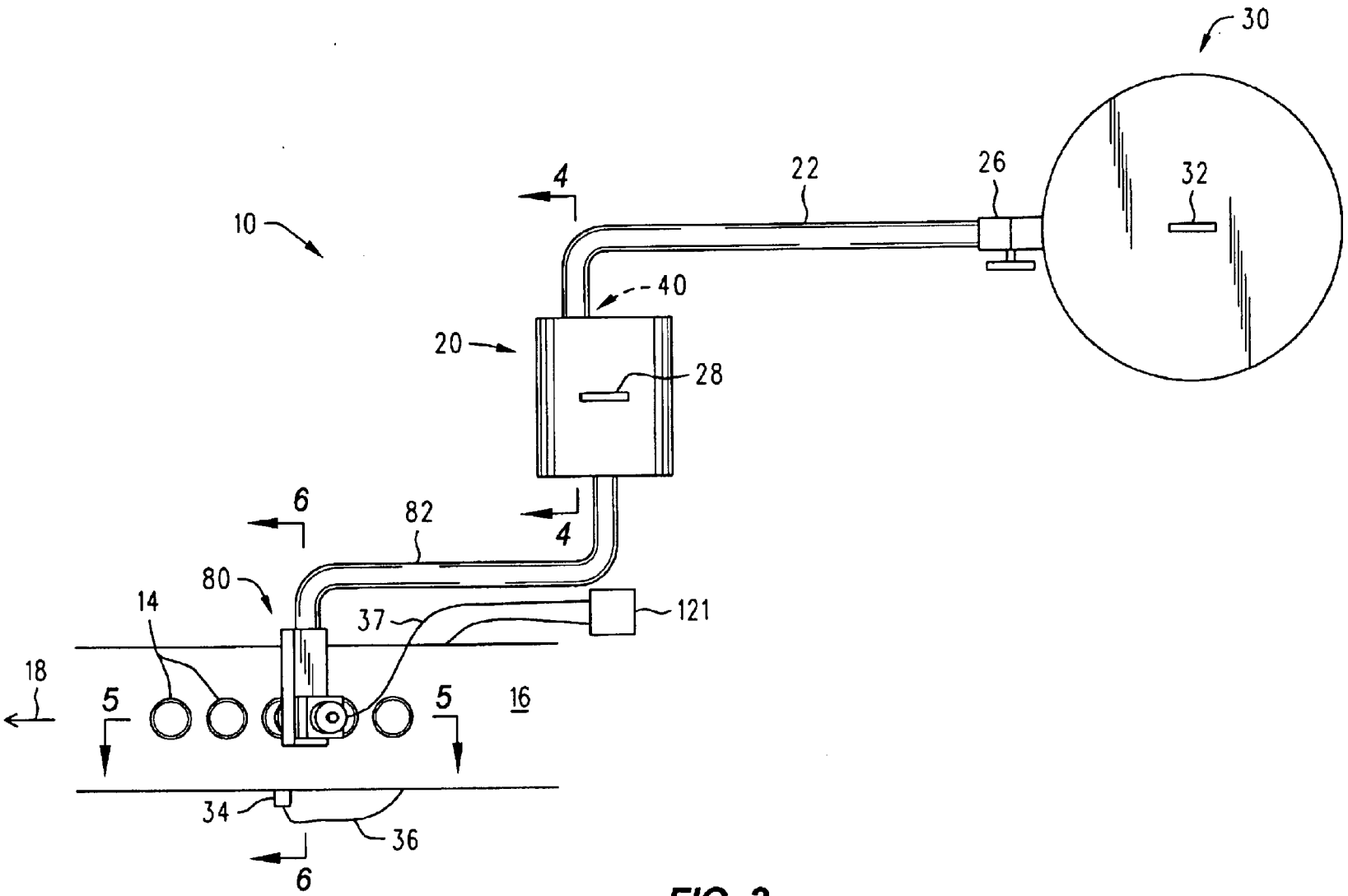
FIG. 2 is a top view of the container strengthening system of FIG. 1.

FIGS. 1 and 2 illustrate the container strengthening system 10 of the present invention. The container strengthening system 10 is adapted to forcibly inject a liquefied gas 12 such as nitrogen into containers 14 such as, for example, metallic cans, in a high-speed filling operation. The containers 14 may contain a beverage such as beer which frequently develops a frothy head during filling of the containers 14. The system 10 preferably injects the liquefied gas 12 into the containers 14 with an adequate force such that the liquefied gas 12 remains within the container 14 and does not roll off the frothy head of the beverage therein.

The container strengthening system 10 may comprise a supply tank 20 comprising a first intake line 22 in fluid flow relation with a source 30 of liquefied gas 12. The source 30 of liquefied gas 12 may be, for example, a tank having a relief valve 32 (schematically illustrated by the designation "R") to maintain the pressure of the liquefied gas 12 therein at an adequate level, e.g. 25 psi, to force the liquefied gas 12 through the first intake line 22 to the supply tank 20. The source 30 of liquefied gas may alternatively be a bulk holding tank (not shown), whereby the liquefied gas 12 may be piped in through the first intake line 22 to the supply tank 20. The liquefied gas 12 may be any non-oxidizing gas such as, for example, liquid nitrogen conventionally added to products such as non-carbonated beverages to increase the pressure within their containers 14 and also to displace oxygen from the headspace above the beverage in the containers 14. The first intake line 22 may comprise a shutoff valve 26 (schematically illustrated by the designation "V") which may open and close the line 22 to the source 30 of liquefied gas 12 as desired.

Figure 3:
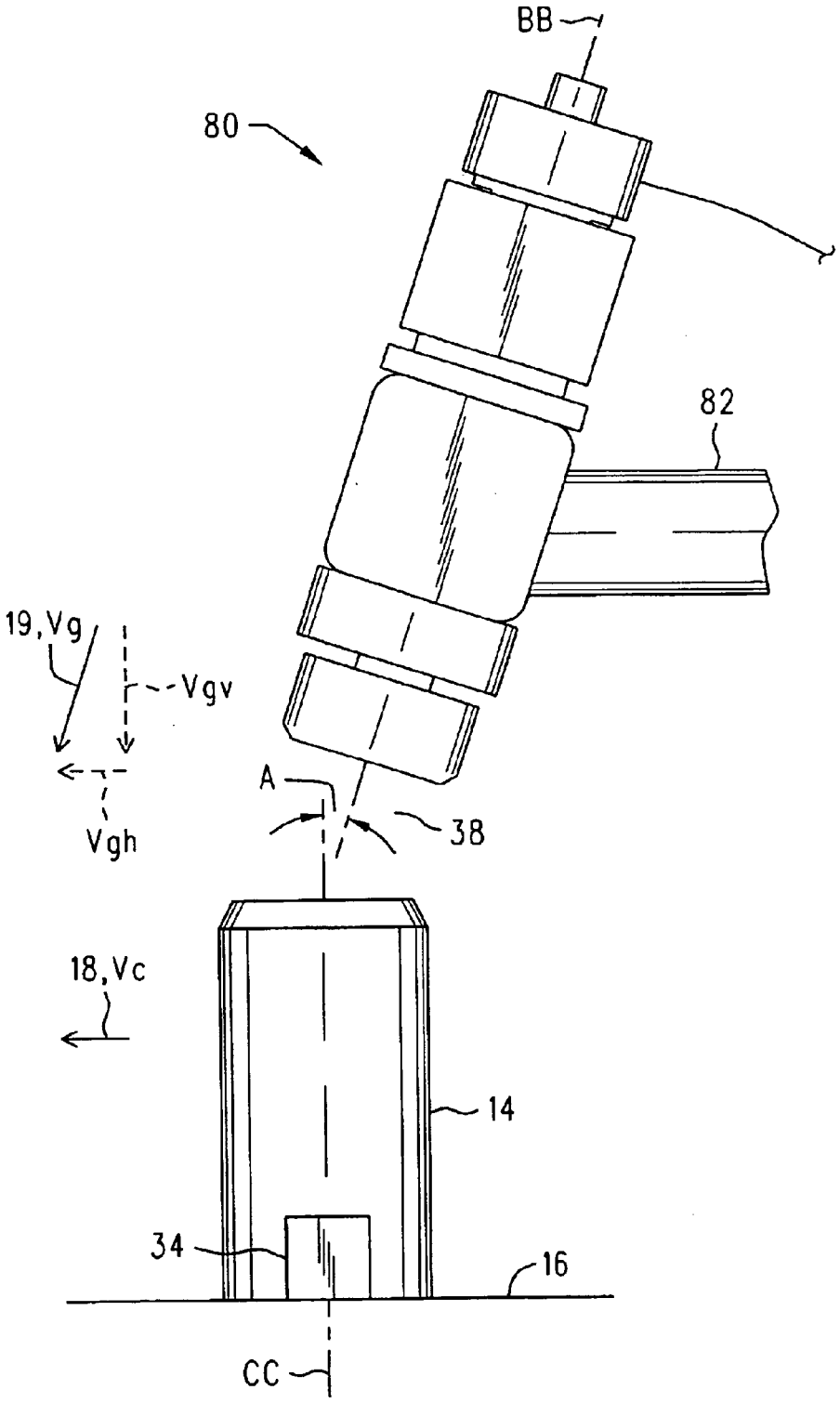
FIG. 3 is an enlarged, front view of a container and an injector apparatus of the container strengthening system of FIGS. 1 and 2.
Figure 4:
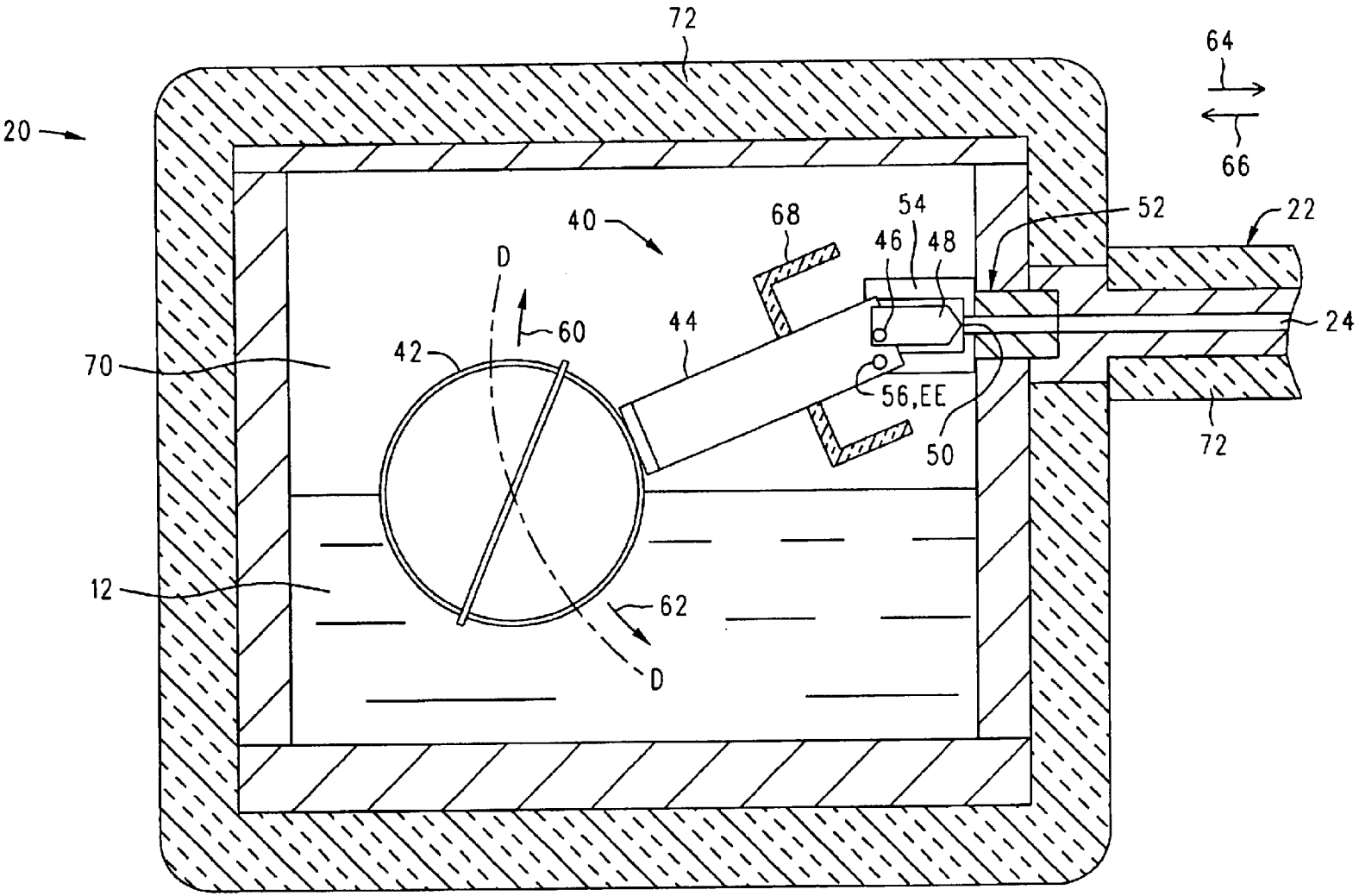
FIG. 4 is a cross-sectional view of a supply tank of the container strengthening system of FIGS. 1 and 2.

The supply tank 20 may further comprise a liquid level control valve 40 (FIG. 2, and described in more detail below with reference to FIG. 4). The liquid level control valve 40 is in fluid flow relation with the first intake line 22 and controls the level of liquefied gas 12 within the supply tank 20. The supply tank 20 may further comprise a back pressure regulator 28 (schematically illustrated by the designation "P") to carefully control the pressure within the tank 20 (which in turn maintains an appropriate pressure within the injector apparatus 80 described below), as is necessary to maintain proper dosing of the liquefied gas 12 into the containers 14. Any conventional back pressure regulator 28 which is adapted for use with liquefied gas such as nitrogen may be utilized to control the pressure in the supply tank 20, such as, for example, back pressure regulator #44-4761-24-501 manufactured by Tescom Corporation of Elk River, Minn. In order to supply adequate force with which to inject the liquefied gas 12 into the containers 14, the pressure in the supply tank 20 is preferably maintained by the back pressure regulator 28 at between about 1 psi and 5 psi, and most preferably approximately 3 psi. A pressure in the supply tank 20 which is too low may cause the liquefied gas 12 injected into the containers 14 to roll off the frothy head of the beverage therein. However, a pressure in the supply tank 20 which is too high may simply cause the liquefied gas 12 being injected into the containers 14 to atomize into the atmosphere 38 (FIG. 3) above the containers 14.

The system 10 may further comprise an injector apparatus 80, described in detail below relative to FIGS. 5–7, comprising a second intake line 82 in fluid flow relation with the supply tank 20. As shown in FIGS. 1–2, the injector apparatus 80 may be positioned directly above a conventional conveyor 16 or the like carrying a row of containers 14 past the injector apparatus 80 in a horizontal direction 18 at a velocity "Vc". In a high-speed filling operation, this velocity "Vc" may be, for example, 4000 inches/minute (utilizing standard beverage cans, this translates to approximately 1000 cans/minute). As best shown in FIG. 3, the injector apparatus 80 is preferably positioned at an angle "A" to each container 14, thereby injecting liquefied gas 12 into the containers 14 in an angled, downward direction 19 at a velocity "Vg". As shown in FIG. 3, the angle "A" is the angle between the central longitudinal axis "BB" of the injector apparatus 80 and the central longitudinal axis "CC" of a container 14. This angle "A" may be determined by the velocity "Vc" of the containers 14 traveling past the injector 80. Specifically, the velocity "Vc" of the containers 14 only has a horizontal component, while the velocity "Vg" of the liquefied gas 12 has both a horizontal component "Vgh" and a vertical component "Vgv". Ideally, the injector apparatus 80 is angled so that the horizontal component "Vgh" of the velocity "Vg" of the liquefied gas 12 is equal to the velocity "Vc" of the containers 14. The closer "Vgh" is to "Vc", the less the possibility that the liquefied gas 12 will splash and roll off of the beverage's frothy head and out of the container 14. In a high-speed filling operation whereby "Vc" is approximately 4000 inches/minute, this angle "A" is preferably between about 15 and 18 degrees, and most preferably approximately 18 degrees. In a relatively faster operation (e.g., 1500 cans/minute), the angle "A" is preferably relatively greater (e.g., approximately 30 degrees).

As shown in FIGS. 1–3, the system 10 may further comprise a sensor 34 which senses the presence of a container 14 below the injector apparatus 80. The sensor 34 is operatively connected via line 36 to a solenoid driver 121 which is then connected via line 37 to the injector apparatus 80, and specifically to the solenoid 120 of the injector apparatus 80 described in further detail below with reference to FIGS. 5 and 6. The sensor 34 may be of the type conventionally known in the art, such as sensor #9-251-03 manufactured by Sencon, Inc. of Bedford Park, Ill. Upon sensing the presence of a container 14, the sensor 34 actuates the solenoid 120, causing the liquefied gas to forcibly flow from the injector apparatus 80 into the container 14.

As noted above and shown in FIG. 4, the liquid level control valve 40 is in fluid flow relation with the first intake line 22 and may be used to control the level of liquefied gas 12 within the supply tank 20. The liquid level control valve 40 prevents liquefied gas 12 from entering the back pressure regulator 28 (shown schematically in FIGS. 1 and 2), thereby preventing freezing and failure of the back pressure regulator without the need for a separate heater adjacent to the back pressure regulator. As shown in FIG. 4, the liquid level control valve 40 may comprise a float 42 fixedly attached to a rod 44. The rod 44 may be hingedly connected with a first pin 46 to a needle stem 48 which is adapted to be received by a valve seat 50. The valve seat 50 may be an opening within a valve body 52 which is directly connected to the opening 24 of the first intake line 22. The valve body 52 may comprise a flange 54 which acts as a linear guide for the needle stem 48. The rod 44 may also be hingedly connected with a second pin 56 to the valve body 52. As shown in FIG. 4, the float 42 is translatable in an arcuate direction 60, 62 along axis DD around axis EE which is defined by the second pin 56 connecting the rod 44 to the valve body 52. As the level of liquefied gas 12 within the tank 20 increases causing the float 42 to rise in direction 60 along axis DD, the rod 44 pushes the needle stem 48 in a linear direction 64 toward the valve seat 50. When the float 42 has risen to a predetermined maximum level within the supply tank 20, the needle stem 48 completely blocks off the valve seat 50 so that no liquefied gas 12 may enter the first intake line 22. The maximum level is determined by the location of the back pressure regulator 28, which is preferably connected to (or close to) the top surface 21 (FIGS. 1 and 2) of the supply tank 20. At levels close to the maximum, the needle stem 48 may only partially block the flow of liquefied gas 12 into the supply tank 20. As the level of liquefied gas 12 within the tank 20 decreases, causing the float 42 to lower in direction 62 along axis DD, the rod 44 pulls the needle stem 48 in a linear direction 66 away from the valve seat 50, allowing the liquefied gas 12 to flow from the first intake line 22 into the tank 20. The liquid level control valve 40 may further comprise a baffle 68, which may consist simply of the bottom portion of a Styrofoam cup, located in the proximity of the first intake line 22. The baffle 68 interrupts the flow of liquefied gas 12 into the supply tank 20 to prevent atomization of the liquefied gas 12 in the atmosphere 70 above the liquefied gas 12 within the tank 20.

Due to the extremely cold temperatures involved in utilizing liquefied gas such as nitrogen, various parts of the system 10 (FIGS. 1 and 2) are preferably insulated. For example, as shown in FIG. 4, the supply tank 20 and first intake line 22 may be covered with insulation 72. As shown in FIG. 5, the second intake line 82, as well as the entire injector apparatus 80, may also be covered with insulation 72. In all of the figures, the insulation has been removed from the injector apparatus 80 for clarity.

Figure 5:
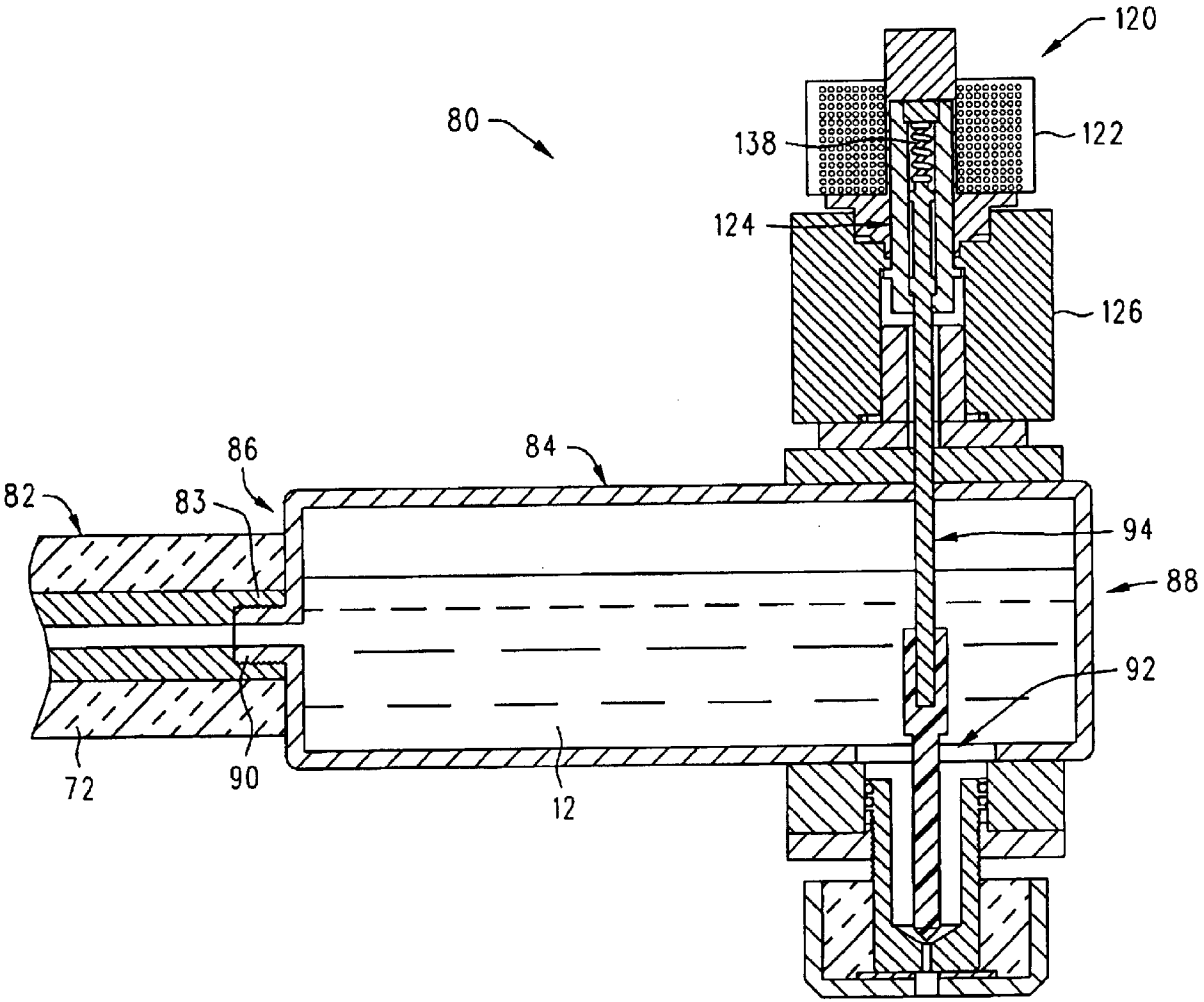
FIG. 5 is a cross-sectional view of the injector apparatus of the container strengthening system of FIGS. 1 and 2.
Figure 6:
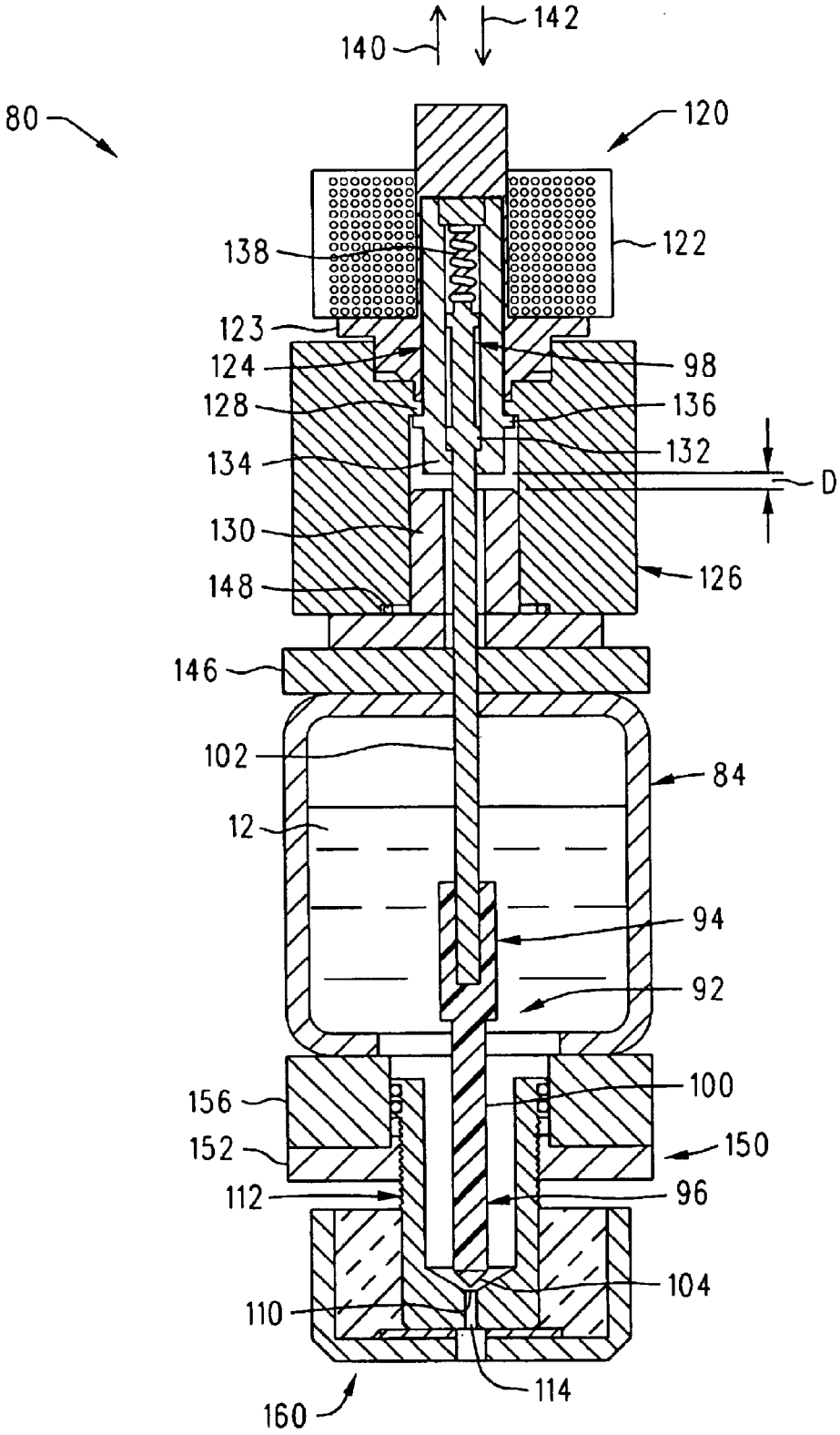
FIG. 6 is another cross-sectional view of the injector apparatus of FIG. 5.
Figure 7:
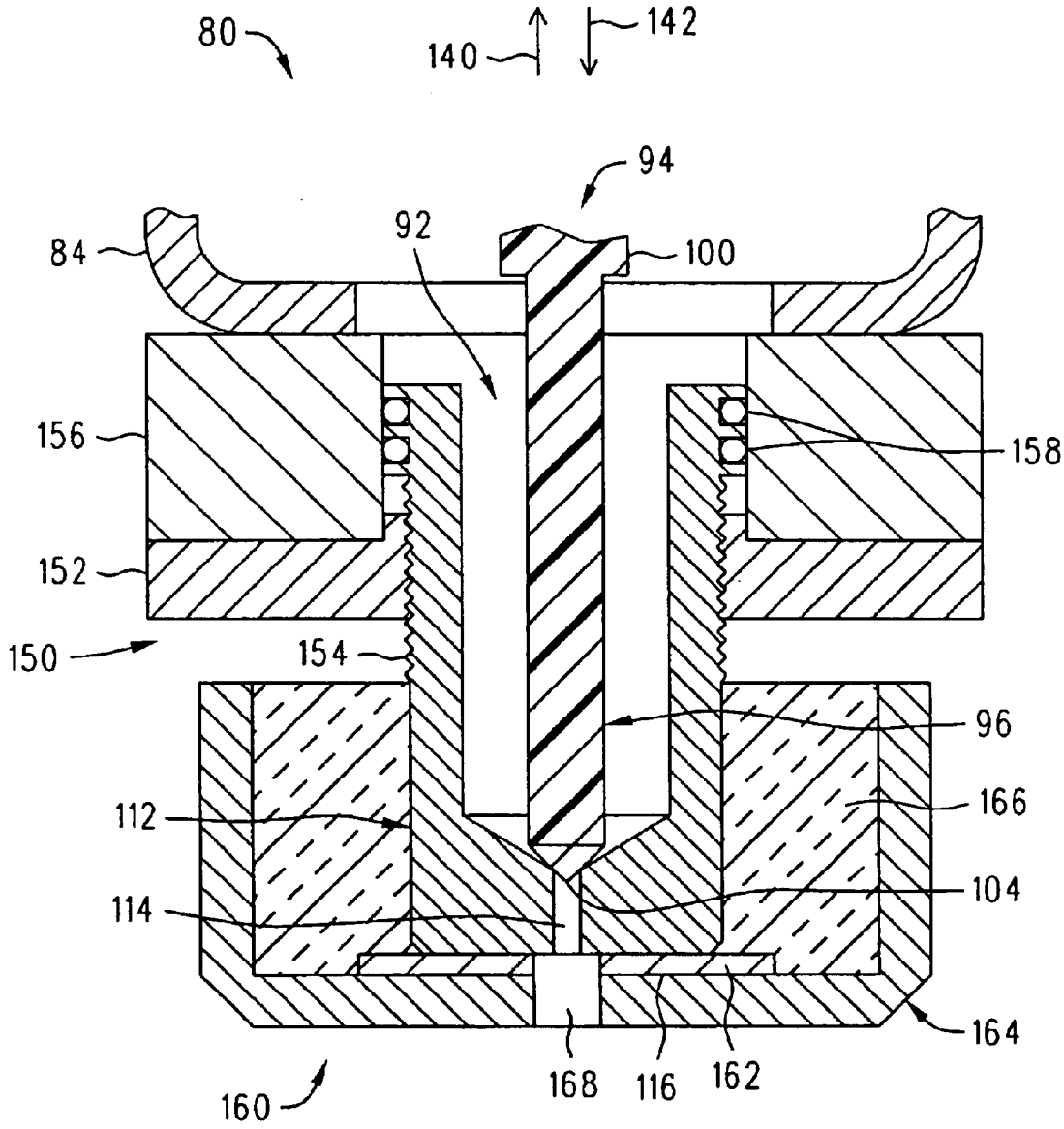
FIG. 7 is an enlarged view of a portion of the injector apparatus of FIG. 5.

Referring now to FIGS. 5–7, the injector apparatus 80 may further comprise a chamber 84 in fluid flow relation with the supply tank 20. As best shown in FIG. 5, the chamber 84 may comprise a first end 86 having a threaded portion 90 which may be secured to a threaded portion 83 of the second intake line 82. The injector apparatus 80 may further comprise an injector valve 92 located within the chamber 84 near the second end 88 thereof. As best shown in FIG. 6, the injector valve 92 may comprise a needle stem 94 having a first end 96 and a second end 98, a valve seat 110, and a substantially straight outflow line 114. The needle stem 94 may be comprised of a first needle portion 100 fixedly attached to a second needle portion 102. The first needle portion 100 may comprise a pointed end 104 which is adapted to be received by the valve seat 110. The valve seat 110 may have a substantially conical shape as shown in FIGS. 5–7 to best accommodate the pointed end 104 of the first needle portion 100. The first needle portion 100 may be manufactured from a plastic material such as, for example, Teflon, which tends to be very durable in extremely cold temperatures. The second needle portion 102 may be manufactured from stainless steel or the like. As best shown in FIG. 7, the valve seat 110 may be an opening within a valve body 112 which is directly connected to the outflow line 114. As noted above, the outflow line 114 is preferably substantially straight, since an outflow line that is bent, curved, or the like may cause the exiting liquefied gas 12 (FIGS. 5 and 6) to atomize in the atmosphere 38 (FIG. 3) above the containers 14, rather than being deposited within the containers 14 as desired.

The injector apparatus 80 may comprise an "open" operating state as shown in FIGS. 5 and 6 whereby the needle stem 94 is positioned away from the valve seat 110, allowing liquefied gas 12 to flow out the outflow line 114. The injector apparatus 80 may also comprise a "closed" operating state as shown in FIG. 7 whereby the needle stem 94 is seated within the valve seat 110, blocking the liquefied gas 12 (FIGS. 5 and 6) from entering the outflow line 114.

As shown in FIGS. 5 and 6, the injector apparatus 80 may further comprise a solenoid 120 operatively connected to the sensor 34 (FIGS. 1–3) via a solenoid driver 121 (FIGS. 1–2) and to the needle stem 94. The solenoid driver 121 may be of the type conventionally known in the art, such as driver #LST-22-DV manufactured by Sencon, Inc., of Bedford Park, Ill. As best shown in FIG. 6, the solenoid 120 may comprise a solenoid coil 122, a coil housing 123, an armature 124 preferably manufactured from stainless steel or iron, a housing 126 comprising an armature back stop 128, and an armature forward stop 130. The solenoid coil 122 may be a conventional, high-performance, quick-responding solenoid coil such as Skinner solenoid coil #L322 manufactured by Parker Hannifin Corporation of Cleveland, Ohio. The housings 123, 126 may be manufactured from stainless steel.

The armature 124 is attached to the needle stem 94 in a manner which causes the needle stem 94 to travel with the armature 124. Specifically, the needle stem 94 may comprise a flange 132 which engages a first flange 134 in the armature 124. When the sensor 34 (FIGS. 1–3) sends a signal to the solenoid 120, the coil 122 is energized for a predetermined amount of time "t" which may be set on the solenoid driver 121 (FIGS. 1–2) and which correlates to the desired amount of liquefied gas 12 to be injected into a container 14. In a high-speed filling operation, the predetermined amount of time "t" set on the solenoid driver 121 may be approximately 10–20 milliseconds. When the coil 122 is energized, a magnetic force is created, causing the armature 124 to travel in an upward direction 140 until a second flange 136 on the armature 124 reaches the back stop 128 in the housing 126. Since the needle stem 94 is connected to the armature 124 as noted above, this upward action by the armature 124 pulls the needle stem 94 away from the valve seat 110 and allows liquefied gas 12 to flow out of the outflow line 114. The injector apparatus 80 is then in the "open" operating state (FIGS. 5 and 6). A biasing device 138 such as a spring may be positioned adjacent to the second end 98 of the needle stem 94 to bias the first end 96 of the needle stem 94 toward the valve seat 110. Thus, when the coil 122 is no longer energized (i.e., when a predetermined amount of liquefied gas 12 has exited the outflow line 114 into a container 14), the needle stem 94 is pushed by the biasing device 138 in a downward direction 142 toward the valve seat 110 such that the needle stem 94 blocks the outflow line 114 from receiving liquefied gas 12. As the needle stem 94 moves downwardly 142, the armature 124 is urged toward the forward stop 130, and the injector apparatus 80 is then in the "closed" operating state (FIG. 7).

As shown in FIG. 6, the distance "D" between the forward stop 130 and the armature 124 when the armature 124 is adjacent to the back stop 128 defines the "stroke" of the armature 124. A high performance, quick-responding solenoid typically has a very limited stroke which may be, for example, on the order of 0.08 inches. The stroke of the armature 124 is typically slightly (e.g., 0.005 to 0.01 inches) more than the stroke of the needle, i.e., the distance that the needle stem 94 travels in each direction 140, 142. As best shown in FIG. 6, the injector apparatus 80 may further comprise an adjuster 146 which assists in mounting the solenoid 120 to the chamber 84. A Teflon O-ring 148 may be provided between the adjuster 146 and the housing 126 to prevent leakage of the liquefied gas 12.

As shown in FIGS. 6 and 7, the injector apparatus 80 may further comprise an adjustment device 150 operatively connected to the valve seat 110 (FIG. 6) for adjusting the position of the valve seat 110 relative to the needle stem 94. Because a high-performance, quick-responding solenoid has a very limited stroke ("D" in FIG. 6) as described above, some allowance must be made for manufacturing tolerance buildup between the valve seat 110 and the pointed tip 104 of the needle stem 94. The adjustment device 150 is provided in order to ensure that the needle stem 94 is seated properly within the valve seat 110 when the injector apparatus 80 is in the "closed" operating state, and that adequate clearance is provided between the needle stem 94 and the valve seat 110 in the "open" operating state, thus providing a proper dosage of liquefied gas 12 into the containers 14 and avoiding atomization of the exiting liquefied gas 12. As shown in FIG. 7, the adjustment device 150 may comprise a threaded engagement device 152 which engages a threaded portion 154 of the valve body 112. The threaded engagement device 152 and valve body 112 may be manufactured from stainless steel. The valve body 112 may be adjusted in an upward direction 140 or a downward direction 142 by turning the valve body 112 relative to the engagement device 152. A housing 156 may be provided between the engagement device 152 and the chamber 84 (or, alternatively, the housing 156 and engagement device 152 may be a single component). The valve body 112 may also be provided with Teflon O-rings 158 between the valve body 112 and housing 156 to prevent leakage of the liquefied gas 12 (FIGS. 5–6).

As best shown in FIG. 7, the injector apparatus 80 may further comprise a heater 160 positioned adjacent to the outflow line 114 to prevent ice buildup within or just outside of the outflow line 114, e.g., on outer surface 116 of the valve body 112. The heater 160 may comprise at least one heating element 162 housed within a cap 164 which may be manufactured from stainless steel. Insulation 166 may be provided between the cap 164 and the valve body 112. An opening 168 may be provided in the cap 164 adjacent to the outflow line 114. The heater 160 may be secured to the valve body 112 by any conventional means such as by utilizing bolts, screws, adhesive, etc.

Figure 8:
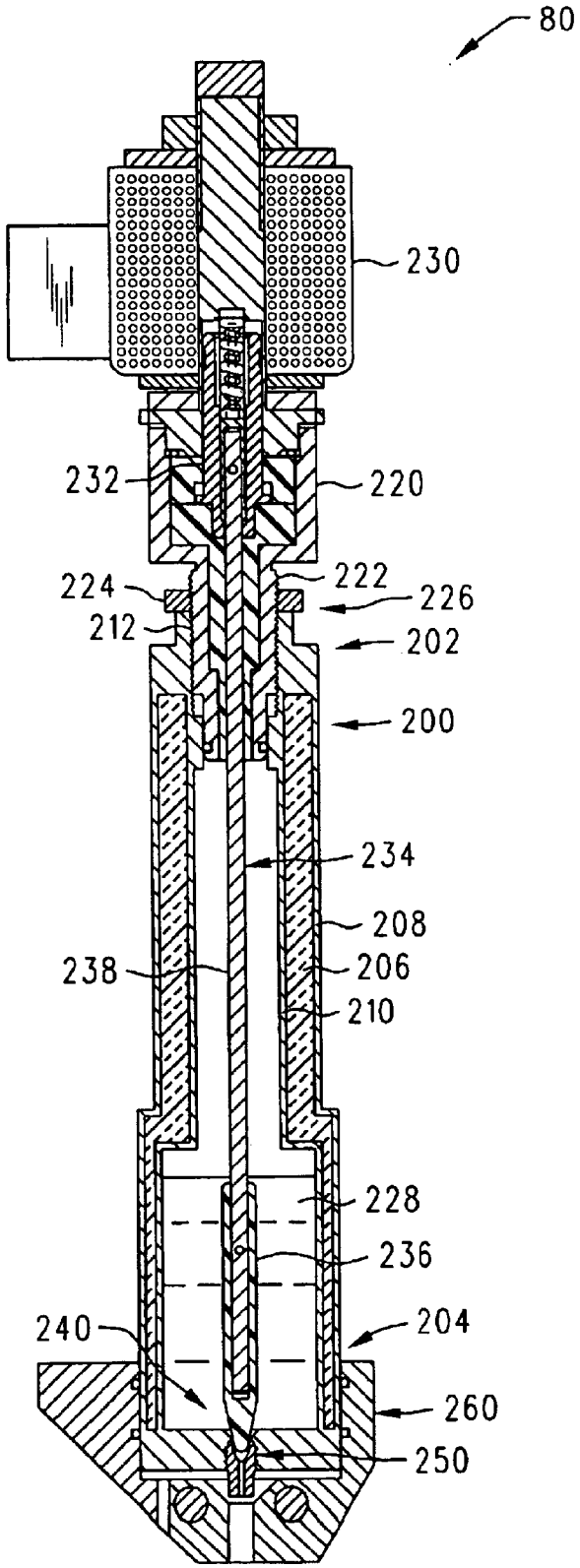
FIG. 8 is a cross-sectional view of another embodiment of the injector apparatus in a "closed" operating state.
Figure 9:
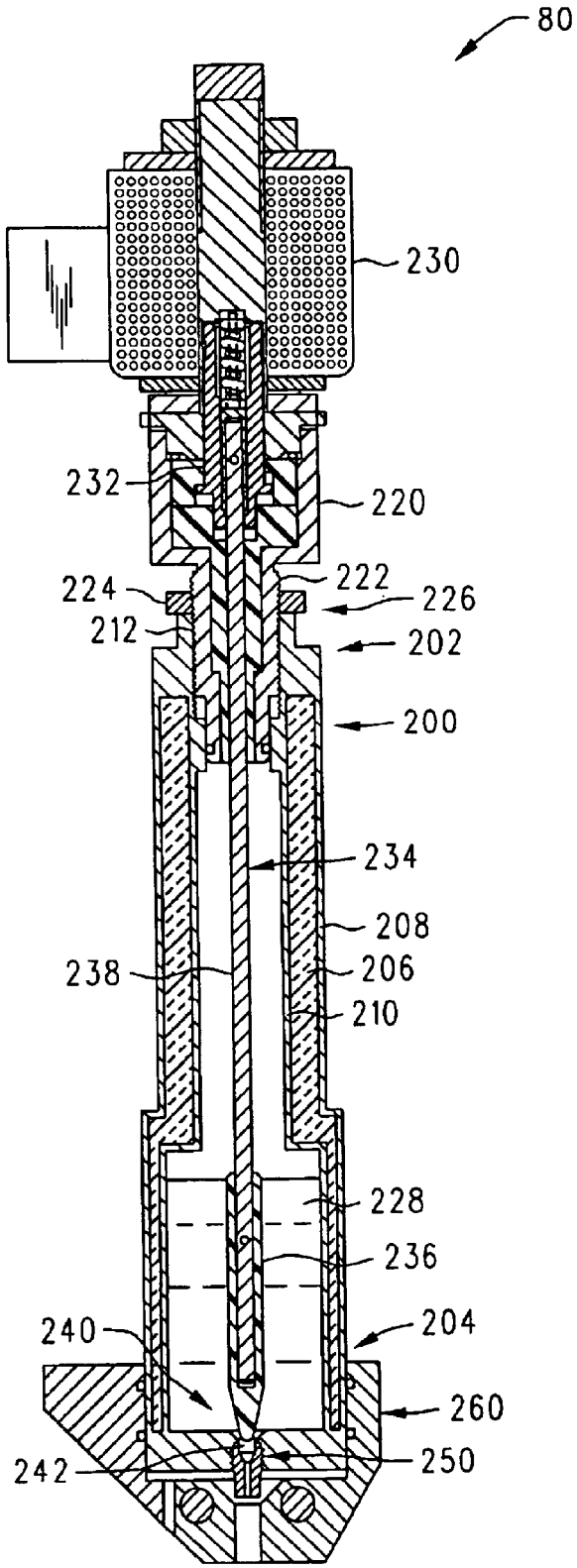
FIG. 9 is a cross-sectional view of another embodiment of the injector apparatus in an "open" operating state.

An alternative embodiment of the injector apparatus 80 is shown in FIGS. 8–11. As best shown in FIGS. 8 and 9, the injector apparatus 80 may comprise a chamber 200 having a first end 202 and a second end 204. The chamber 200 may be of the type found on injector Model No. LCI-2000 manufactured by VBS Industries of Campbell, Calif. The chamber 200 may be manufactured from a metal such as stainless steel or the like, and may have an inner core 206 of insulation. More specifically, the chamber 200 may comprise a metal (stainless steel or the like) inner wall 208 and a metal outer wall 210 with an inner core 206 of insulation therebetween. The chamber 200 may have an inner threaded portion 212 at the first end 202 thereof. At the inner threaded portion 212, the chamber 200 may be secured to a housing 220 which has an outer threaded portion 222. The threaded portions 212, 222, along with a threaded locking nut 224, provide an adjustment device 226 which, like the adjustment device 150 described above relative to FIG. 6, allows the position of the valve seat 242 (FIGS. 9 and 10) relative to the needle stem 234 to be adjusted (and then locked in with the locking nut 224) as desired. The adjustment device 226 will be described in more detail below relative to FIG. 11. The injector apparatus 80 is shown in a "closed" operating state in FIG. 8 whereby the needle stem 234 is seated within the valve seat 242 (FIGS. 9 and 10), blocking the liquefied gas 228 (which may be the same as the liquefied gas 12, FIGS. 1–6, described above) from entering the outflow line 244 (FIG. 10). The injector apparatus 80 is shown in an "open" operating state in FIG. 9 (as well as FIGS. 10–11) whereby the needle stem 234 is positioned away from the valve seat 242 (FIGS. 9 and 10), allowing liquefied gas 228 to flow out the outflow line 244.

As shown in FIGS. 8 and 9, the injector apparatus 80 may further comprise a solenoid 230 including an armature 232, which may be substantially the same as the solenoid 122 and armature 124, respectively, described above relative to FIGS. 5–6. The needle stem 234 may comprise a first needle portion 236 and a second needle portion 238, which may be attached to the armature 232. A valve body 250 and a heater 260 may be attached to the chamber 200 at the second end 204 thereof.

Figure 10:
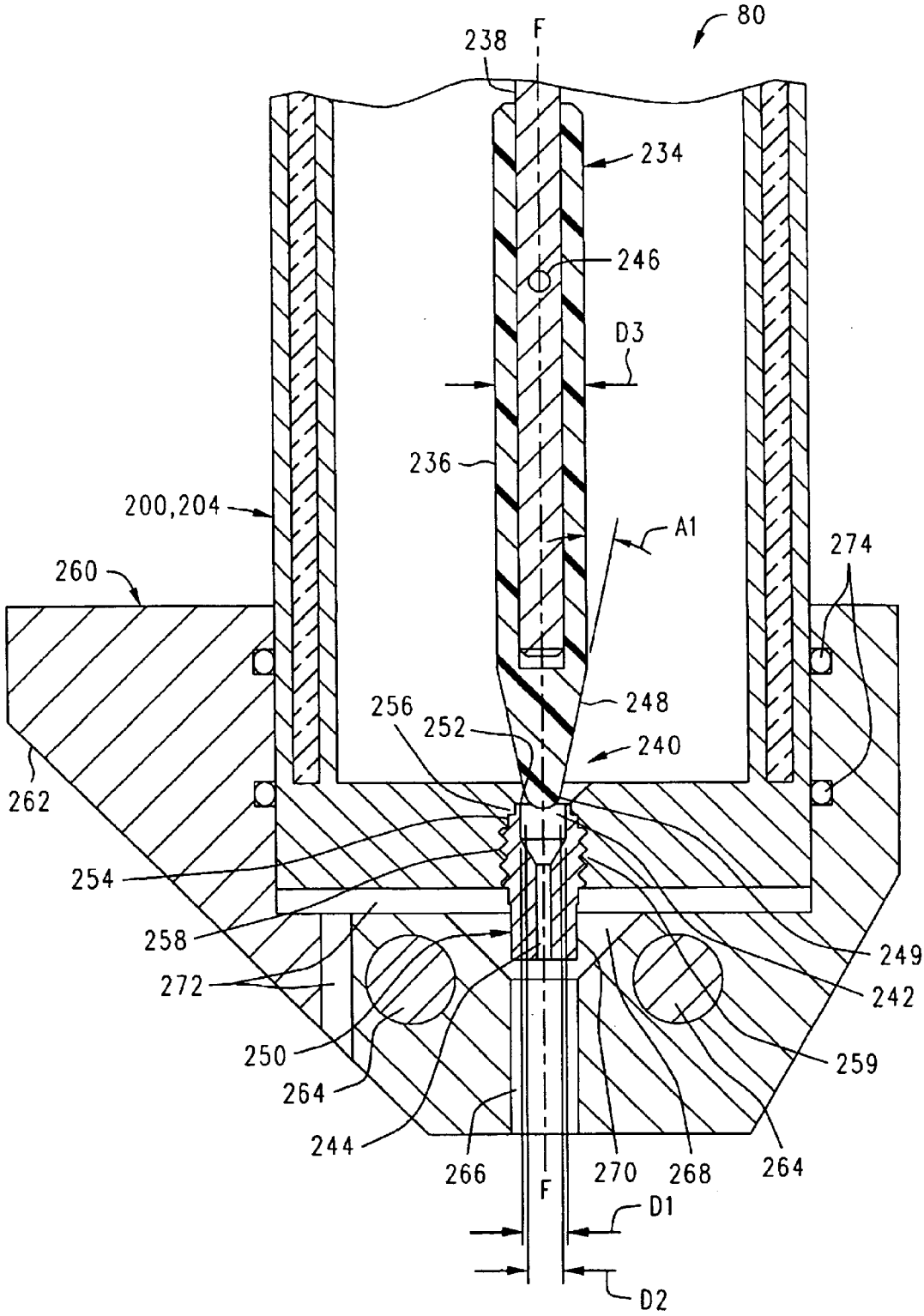
FIG. 10 is an enlarged view of a portion of the injector apparatus of FIG. 9.

As best shown in FIG. 10, the injector apparatus 80 may further comprise an injector valve 240 located within the chamber 200 near the second end 204 thereof. The injector valve 240 may comprise the needle stem 234 described above, as well as a valve seat 242 and a substantially straight outflow line 244 in a valve body 250. The valve body 250 may be manufactured from a metal such as stainless steel. The first needle portion 236 of the needle stem 234 may be attached to the second needle portion 238 using a roll pin 246 or the like which extends through both the first needle portion 236 and the second needle portion 238. The first needle portion 236 may be manufactured from a plastic material such as Teflon, while the second needle portion 238 may be manufactured from a metal such as stainless steel. The first needle portion 236 preferably has a tapered end portion 248 which is adapted to be received by the valve seat 242. The tapered end portion 248 may have a rounded end 249 as shown in FIG. 10. The degree of tapering of the tapered end portion 248 may be such that the angle "A1", FIG. 10, between an axis parallel to the central longitudinal axis "FF" of the injector apparatus 80 and an imaginary line extending tangentially from the sidewall of the tapered end portion 248 of the needle stem 234 is preferably between about 3 and 12 degrees. The valve seat 242 preferably has a diameter "D1" which is larger than a diameter "D2" on the tapered end portion 248 (preferably near the rounded end) and smaller than a diameter "D3" on the first portion 236 of the needle stem 234. This allows the tapered end portion 248 of the needle stem 234 to be securely seated within the valve seat 242 as shown in FIG. 8 and to provide a tight, substantially leak-free seal at the valve seat 242. To further control leakage at the needle stem 234/valve seat 242 interface, the valve body 250 preferably has a sharp (e.g., not rounded, beveled, etc.) circumferential edge 252 at the valve seat 242.

As shown in FIG. 10, the valve body 250 may further comprise a stair-stepped portion 254 which is adapted to engage flanges 256 in the chamber 200. The valve body 250 may also comprise a threaded portion 258 which is adapted to engage a threaded portion 259 of the chamber at the second end 204 thereof. Such a configuration provides a secure, leak-free engagement between the valve body 250 and the chamber 200 and reduces or eliminates the need for O-rings or the like (e.g., O-rings 158 described above with reference to FIG. 7). Unlike the injector apparatus 80 shown in FIGS. 5–7 which has an adjustment device 150 that is located adjacent to the valve seat 110 (FIG. 6), the adjustment device 226 in the injector apparatus 80 of the embodiment shown in FIGS. 8–11 is located at the opposite end (i.e., the first end 202) of the chamber 200 as noted above and described in further detail below.

As noted above, the injector apparatus 80 may further comprise a heater 260 which, like the heater 160 described above relative to FIG. 6, is positioned adjacent to the outflow line 244 (i.e., at least close enough for heat exchange to occur) to prevent ice buildup within or just outside of the outflow line 244. As best shown in FIG. 10, the heater 260 may comprise a cap-like housing 262 which may be manufactured from a metal such as stainless steel and at least one heating element 264 within the housing 262. An outflow opening 266 may be provided in the housing 262 adjacent to the outflow line 244 in the valve body 250. As shown in FIG. 10, the outflow opening 266 may have a funnel-shaped upper portion 268 which is adapted to accommodate the lower portion 270 of the valve body 250. The heater 260 may further comprise a vent opening 272 which is connected to the funnel-shaped upper portion 268 of the outflow opening 266. A preferably dry gas such as air or, most preferably, nitrogen gas may be injected and circulated through the vent opening 272 in order to prevent moisture from collecting on the valve body 250 and surrounding area. The heater 260 may be secured to the chamber by any conventional means such as by utilizing bolts, screws, adhesive, or the like. Alternately, as shown in FIG. 10, the heater 260 may comprise one or more O-rings 274 for frictionally gripping the second end 204 of the chamber 200.

Figure 11:
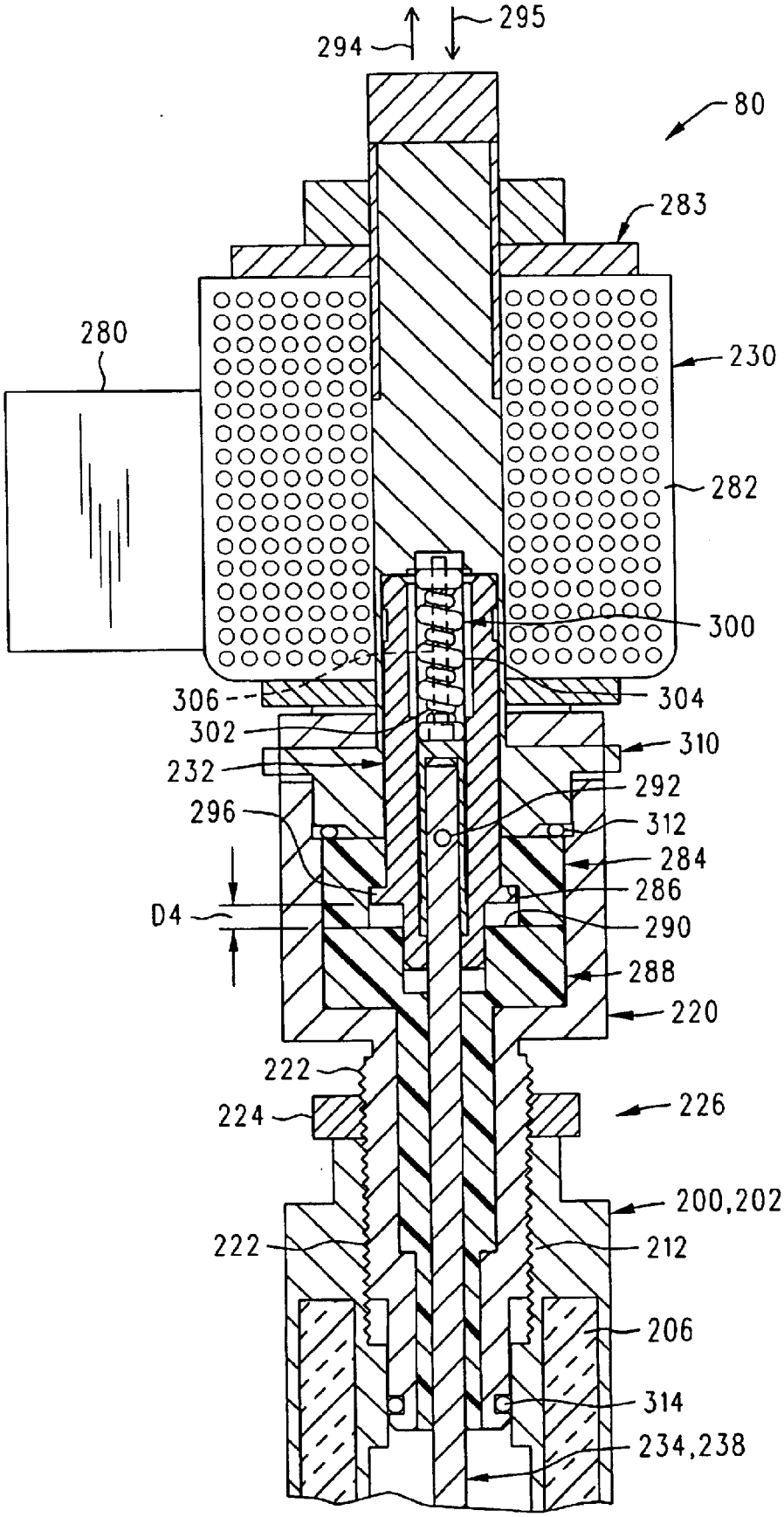
FIG. 11 is an enlarged view of another portion of the injector apparatus of FIG. 9.

Referring now to FIG. 11, the injector apparatus 80 may further comprise a bracket 280 for housing electrical components (not shown) and the like connected to the solenoid 230. The solenoid 230 may comprise a solenoid coil 282 (which may be the same as the solenoid coil 122, FIG. 6, described above), a coil housing 283, an armature 232 preferably manufactured from a metal such as stainless steel or iron, a first insert 284 having an armature back stop 286 and a second insert 288 having an armature forward stop 290. The inserts 284, 288 are preferably manufactured from a plastic such as Teflon, and may alternatively be a unitary part. Like the armature 124 (FIG. 6) discussed above, the armature 232 (FIG. 11) is attached to the needle stem 234 in a manner which causes the needle stem 234 to travel with the armature 232. Specifically, the armature 232 may be attached to the needle stem 234 using a roll pin 292 or the like which extends through both the armature 232 and the needle stem 234. When the coil 282 is energized, a magnetic force is created, causing the armature 232 to travel in an upward direction 294 until a flange 296 on the armature 232 reaches the armature back stop 286. Since the needle stem 234 is connected to the armature 232 as noted above, this upward action by the armature 232 pulls the needle stem 234 away from the valve seat 242 (FIGS. 9 and 10) and allows liquefied gas 228 (FIGS. 8 and 9) to flow out of the outflow line 244. The injector apparatus 80 is then in the "open" operating state as shown in FIGS. 9–11. When the coil 282 is no longer energized, (i.e., when a predetermined amount of liquefied gas 228 has exited the outflow line 244 into a container 14 (FIGS. 1–3), the armature 232 and needle stem 234 are pushed in a downward direction 295 by a biasing assembly 300. The armature flange 296 is urged toward the armature forward stop 290, and the needle stem 234 blocks the outflow line 244 from receiving liquefied gas 228. The injector apparatus 80 is then in the "closed" operating state as shown in FIG. 8. The "stroke" of the armature 232 is defined by the distance "D4" between the forward stop 290 and the armature flange 296 when the armature flange 296 is adjacent to the back stop 286 as shown in FIG. 11 (i.e., when the injector apparatus 80 is in the "open" operating state). The distance "D4" may be the same as the distance "D", FIG. 6, discussed above relative to the armature 124.

As best shown in FIG. 11, the biasing assembly 300 may comprise a first biasing device 302 such as a spring coaxially aligned with and nested inside a second biasing device 304 such as a larger-diameter spring. The needle stem 234 may have an extending portion 306 on which the biasing devices 302, 304 may be mounted to assist in supporting and maintaining the coaxially alignment of the biasing devices 302, 304. The first biasing device 302 is designed to exert a downward 295 force on the needle stem 234, while the second biasing device 304 is designed to exert a downward 295 force on the armature 232. The injector apparatus 80 may further comprise an adjuster 310 which, like the adjuster 146 (FIG. 6) discussed above, assists in mounting the solenoid 230 to the chamber 200. A Teflon O-ring 312 may be provided between the adjuster 310 and the first insert 284 to prevent leakage of the liquefied gas 228 (FIGS. 8 and 9).

As noted above, the injector apparatus 80 may further comprise an adjustment device 226 operatively connected to the valve seat 242 (FIGS. 9 and 10) for adjusting the position of the valve seat 242 relative to the needle stem 234. Because a high-performance, quick-responding solenoid has a very limited stroke as described above, some allowance must be made for manufacturing tolerance buildup between the valve seat 242 and the tapered end portion 248 (FIG. 10) of the needle stem 234. The adjustment device 226 is provided in order to ensure that the needle stem 234 is seated properly within the valve seat 242 when the injector apparatus 80 is in the "closed" operating state, and that adequate clearance is provided between the needle stem 234 and the valve seat 242 in the "open" operating state, thus providing a proper dosage of liquefied gas 228 into the containers 14 and avoiding atomization of the exiting liquefied gas 228. As shown in FIG. 11, the adjustment device 226 may comprise a housing 220 with an outer threaded portion 222 which engages an inner threaded portion 212 of the chamber 200. As noted above, the needle stem 234 is connected to the armature 232, and the armature 232 is secured between the first insert 284 and second insert 288. The inserts 284, 288, are positioned within the housing 220. Also, as shown in FIG. 10 and described above, the valve seat 242 is located within the valve body 250, which is secured to the chamber 200. Thus, by rotating the housing 220 relative to the chamber 200 (or rotating the chamber 200 relative to the housing 220), the position of the valve seat 242 (FIGS. 9 and 10) relative to the needle stem 234 may be adjusted. As shown in FIG. 11, a threaded locking nut 224 which engages the outer threaded portion 222 of the housing 220 may be used to selectively lock in the desired position of the housing 220 on the chamber 200. The housing 220 and threaded locking nut 224 may both be manufactured from a metal such as stainless steel. A Teflon O-ring 314 may be provided between the housing 220 and chamber 200 to prevent leakage of the liquefied gas from the chamber 200.

Figure 12:
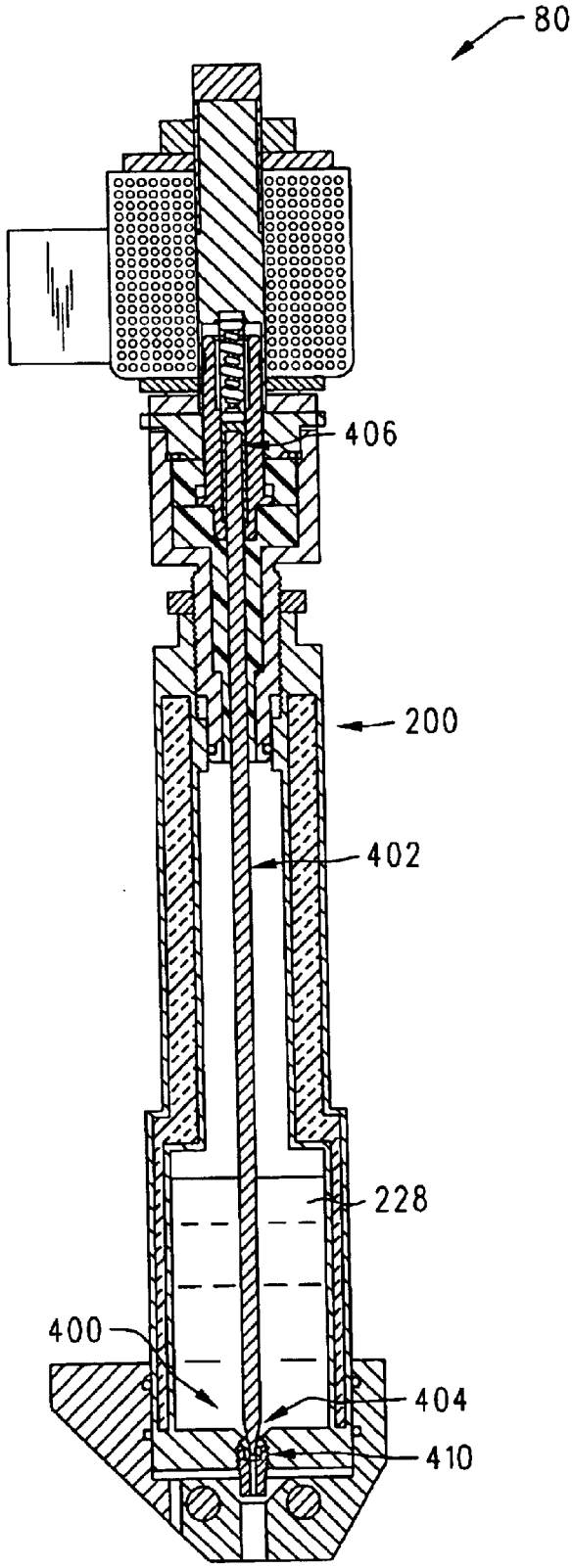
FIG. 12 is a cross-sectional view of yet another embodiment of the injector apparatus in a "closed" operating state.
Figure 13:
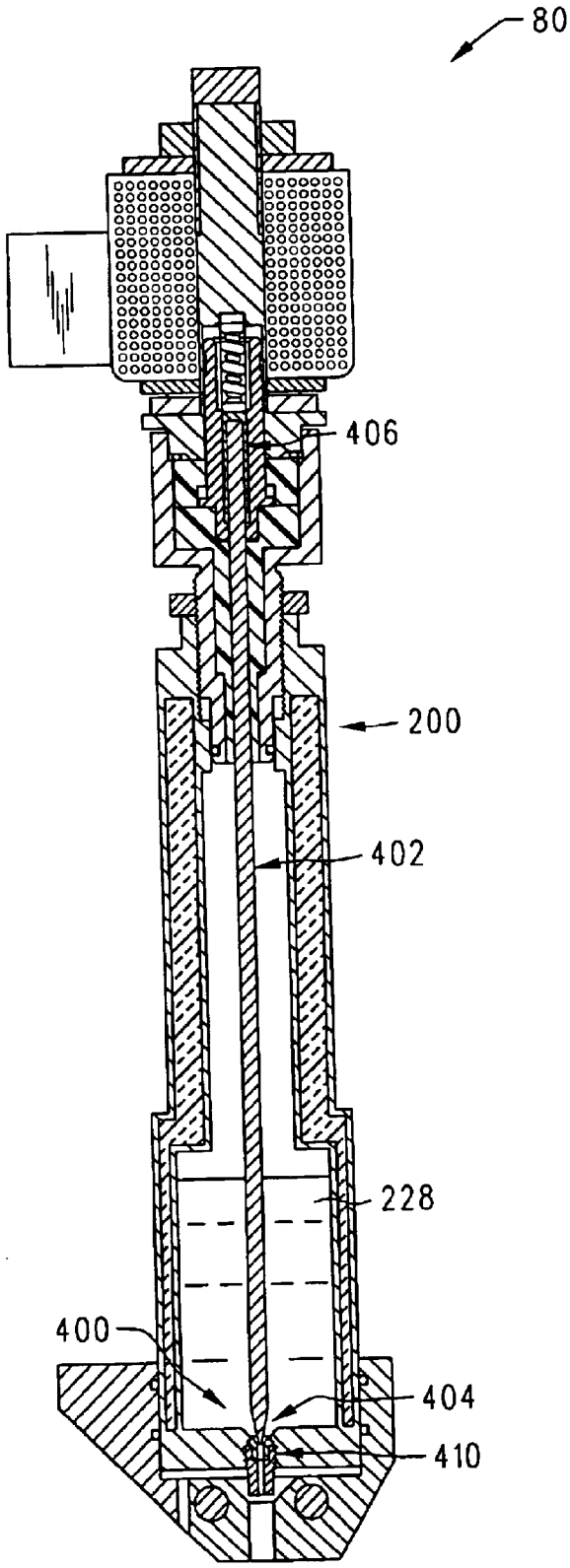
FIG. 13 is a cross-sectional view of the embodiment of the injector apparatus of FIG. 12 in an "open" operating state.
Figure 14:
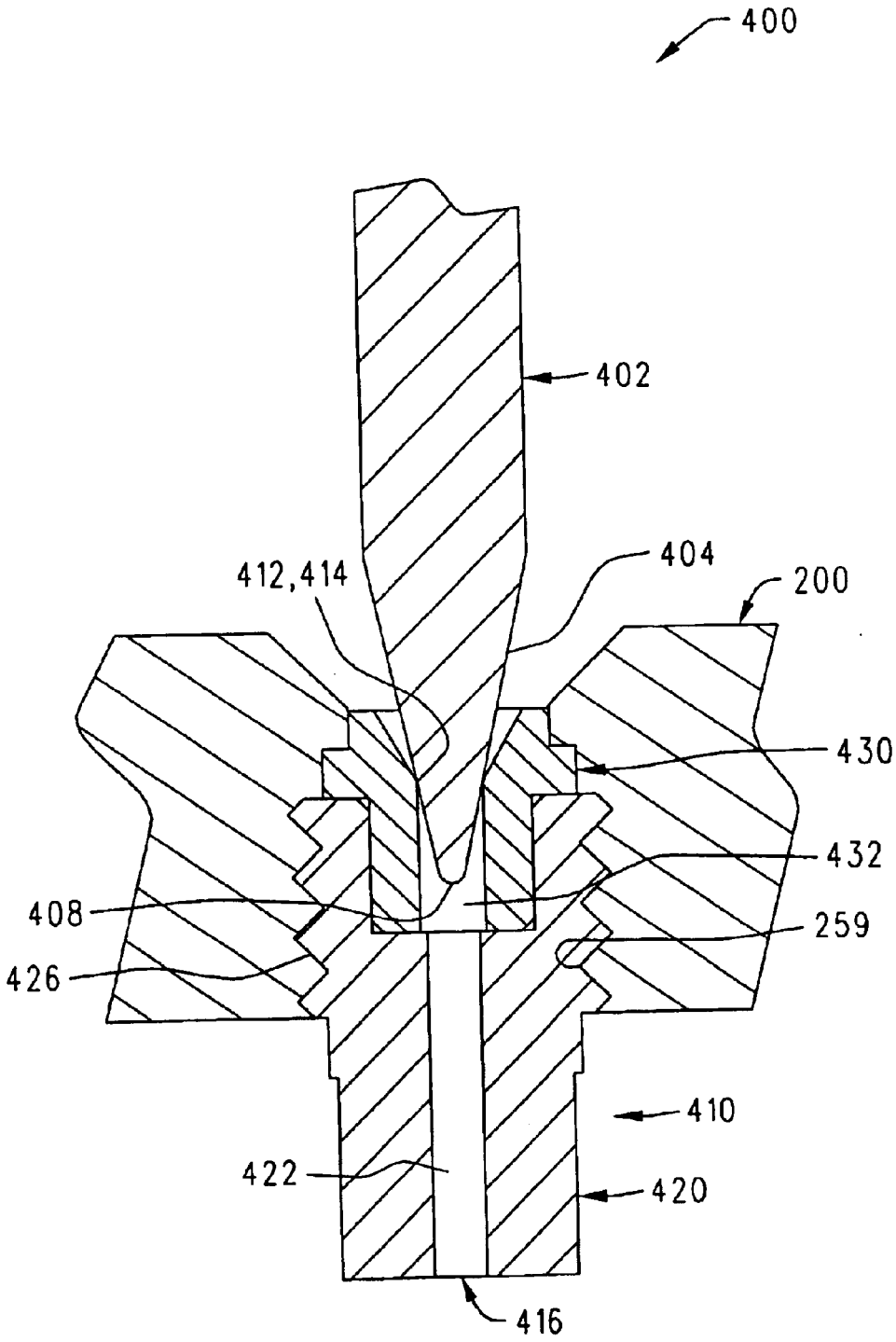
FIG. 14 is an enlarged view of a portion of the injector apparatus of FIG. 12.
Figure 15:
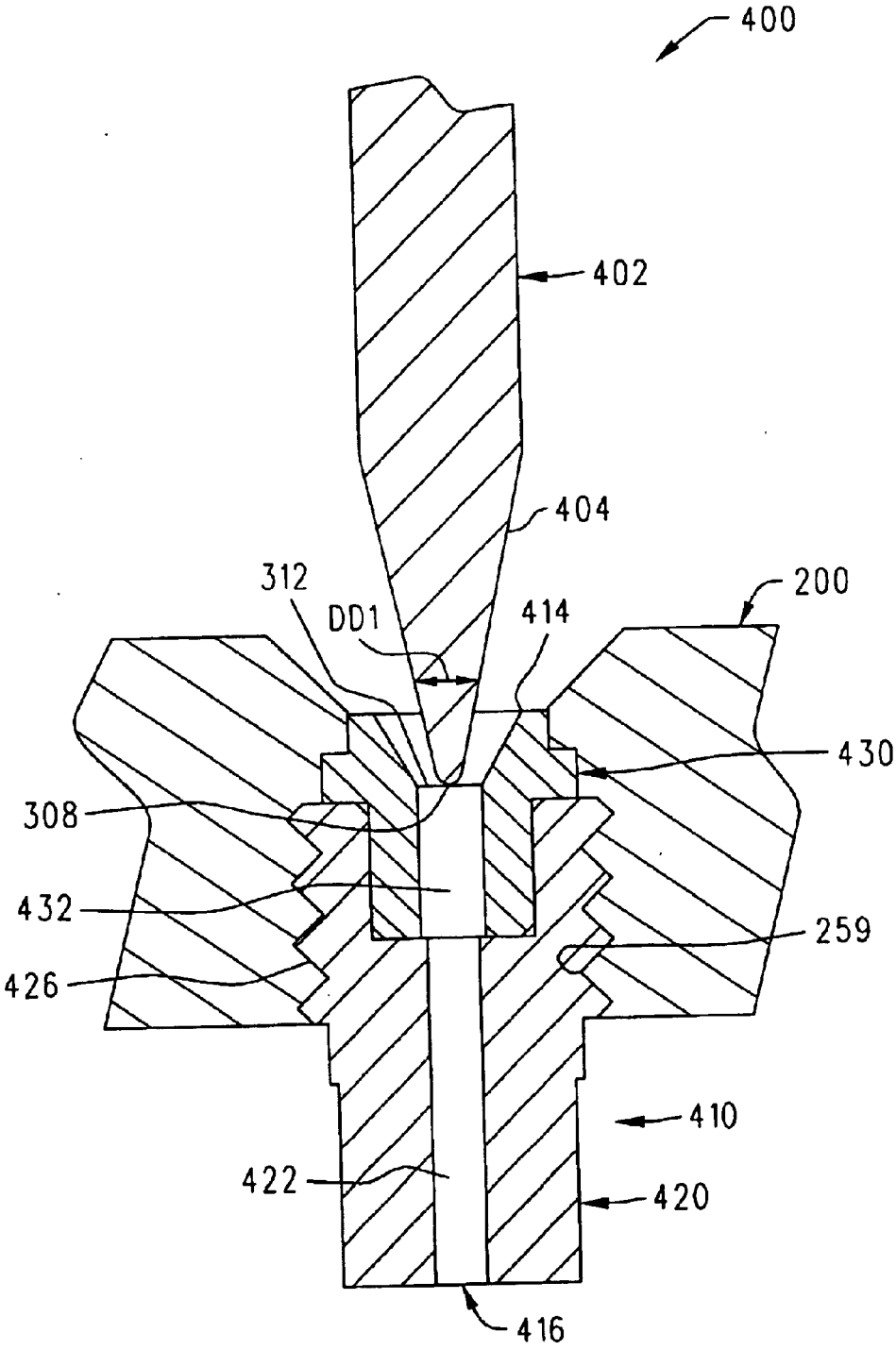
FIG. 15 is an enlarged view of a portion of the injector apparatus of FIG. 13.

Another alternative embodiment of the injector apparatus 80 is shown in FIGS. 12–16. In this embodiment, the injector apparatus 80 may be substantially identical to that shown in FIGS. 8–11, except for the injector valve 400 as described below. FIG. 12 shows the injector apparatus 80 in a "closed" operating state, and FIG. 14 is an enlarged view of the injector valve 400 of FIG. 12. FIG. 13 shows the injector apparatus in an "open" operating state, and FIG. 15 is an enlarged view of the injector valve 400 of FIG. 13.

Referring to FIGS. 12–15, the injector valve 400 may comprise a needle stem 402 and a valve body 410 with a valve seat 412 (FIGS. 14–15) and a substantially straight outflow line 416. The needle stem 402 may be of a unitary construction having a first, tapered end portion 404 (FIGS. 14–15) and a second end portion 406 (FIGS. 12–13). As best shown in FIGS. 14–15, the first, tapered end portion 404 of the needle stem 402 may have a rounded end 408. The needle stem 402 is preferably manufactured from a material with a relatively high wear rate and a smooth finish, in particular on its tapered end portion 404, in order to provide a tight seal between the tapered end portion 404 of the needle stem 402 and the valve seat 412 when the injector valve 400 is in a "closed" operating state as shown in FIGS. 12 and 14. It is also preferable to reduce the mass of the needle stem 402 as much as possible in order to improve the response time of the solenoid-driven injector valve 400. In addition, the needle stem 402 is preferably substantially non-resilient. Thus, the needle stem 402 may be manufactured from a material such as, for example, tungsten carbide or stainless steel, and may also have a coating thereon that may be comprised of, for example, titanium nitride (TiN). Alternatively, a coating may be provided on only a portion of the needle stem 402 such as, for example, the tapered end portion 404 thereof.

Figure 16:
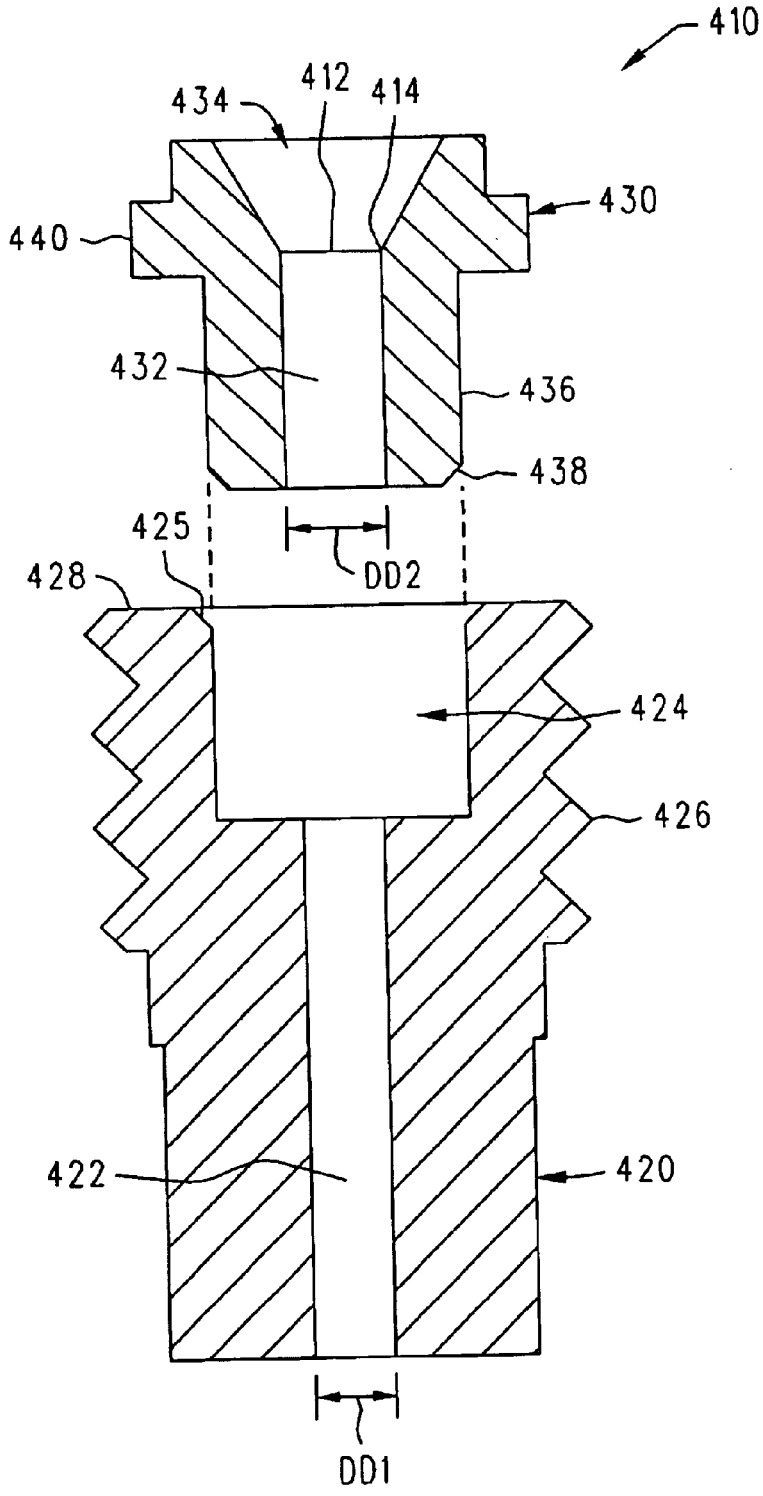
FIG. 16 is an exploded, cross-sectional view of a valve body of the injector apparatus of FIGS. 12–15.

FIG. 16 is an exploded view of the valve body 410, which may be comprised of a first body member 420 and a second body member 430. The first body member 420 has a substantially straight outflow line 422 having a first diameter "DD1" and an upper opening 424 which may be a cylindrical opening. The upper opening 424 may have a chamfered peripheral edge 425 in order to facilitate press-fitting the second body member 430 into the opening 424 in the first body member 420. Like the valve body 250 described above with reference to FIGS. 8–10, the first body member 420 of the valve body 410 may comprise a threaded portion 426 which is adapted to engage a threaded portion 259 of the chamber 200 (FIGS. 14–15). Also like the valve body 250 described above, the first body member 420 of the valve body 410 may be manufactured from a metal such as stainless steel. The first body member 420, and, in particular, the threaded portion 426 thereof, may be gold plated in order to eliminate galling thereon.

The second body member 430 of the valve body 210 also has a substantially straight outflow line 432 having a second diameter "DD2", FIG. 16. As best shown in FIGS. 14–15, the outflow line 422 in the first body member 420 is aligned with the outflow line 432 in the second body member 430 in order to form a continuous, substantially straight outflow line 416 in the valve body 410. The second body member 430 has an upper opening 434 that may be funnel-shaped to facilitate the flow of liquefied gas 228 (FIGS. 12 and 13) past the tapered end portion 404 of the needle stem 402 and through the outflow line 416 of the valve body 410 when the injector apparatus is in an "open" operating state as shown in FIG. 13. The second body member 430 has a lower portion 436 that may be cylindrical and is adapted to be press-fit into the upper opening 424 of the first body member 420. As best shown in FIG. 16, the lower portion 436 may have a chamfered peripheral edge 438 in order to facilitate press-fitting the second body member 430 into the upper opening 424 in the first body member 420. The second body member 430 may further include a flange 440 adapted to abut an upper surface 428 of the first body member 420. Like the valve seat 242 in the valve body 250 described above, the second body member 430 of the valve body 410 preferably has a sharp (e.g., not rounded, beveled, etc.) circumferential edge 414 at the valve seat 412. The second body member 430 is preferably constructed from a material with a relatively high wear rate having a smooth finish, such as, for example, tungsten carbide with a nickel binder. This material is also relatively stable with regard to temperature change, i.e., its coefficient of thermal expansion is relatively low (approximately 0.0000028 in/in/degree F.).

Since the first body member 420 is preferably manufactured from a relatively softer material than the second body member 430, the outflow line 432 in the second body member 430 is preferably pre-drilled to a maximum desired diameter "DD2" which may be, for example, approximately 0.050 inches. The outflow line 422 in the first body member 420 may be pre-drilled to a diameter "DD1" which may be less than or equal to "DD2". Most preferably, the pre-drilled diameter "DD1" of the outflow line 422 is somewhat less than the maximum desired diameter "DD2", for example, between about 0.040 and 0.043 inches. Therefore, as conditions may require, the outflow line 422 in the first body member 420 may be enlarged at any time by drilling the line 422 to a diameter of up to the maximum desired diameter "DD2". The valve seat 412 preferably has the same diameter "DD1" as the outflow line 432 in the second body member 430. As indicated in FIG. 15, at a position on the tapered end portion 404 thereof, the needle stem 402 has a diameter equal to the diameter "DD1" of the outflow line 432 of the second body member 430 so that the tapered end portion 404 of the needle stem 402 may be securely seated within the valve seat 412 as best shown in FIG. 14.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

We claim:

1. An injector apparatus for injecting a liquefied gas into containers at an angle to said containers in a high-speed filling operation, comprising:

a) a central longitudinal axis which is positioned at an angle to the central longitudinal axis of said containers;

b) an injector valve located within a chamber, said injector valve comprising:

i) a needle stem having a tapered end portion with a rounded end; and ii) a valve body having a first body member and a second body member, said first body member having a substantially straight outflow line with a first diameter and an upper opening, and said second body member having an upper, funnel-shaped opening, a substantially straight outflow line with a second diameter and a valve seat, and a lower portion that is mounted within said upper opening of said first body member, iii) wherein said outflow line of said first body member is aligned with said outflow line of said second body member;

c) an open operating state whereby said tapered end portion of said needle stem is positioned within said upper, funnel-shaped opening of said second body member, allowing said liquefied gas within said chamber to flow out of said outflow line of said second body member, said outflow line of said first body member, and into one of said containers; and d) a closed operating state whereby said tapered end portion of said needle stem is seated within said valve seat, blocking said liquefied gas within said chamber from entering said outflow line.

2. The apparatus of claim 1, said second diameter of said outflow line of said second body member being at least as large as said first diameter of said outflow line of said first body member.

3. The apparatus of claim 1, said second diameter of said outflow line of said second body member being larger than said first diameter of said outflow line of said first body member.

4. The apparatus of claim 1, said second body member of said valve body having a sharp circumferential edge at said valve seat.

5. The apparatus of claim 1, said second body member further comprising a flange portion that abuts an upper surface on said first body member.

6. The apparatus of claim 1, said needle stem being manufactured from stainless steel and having a titanium nitride coating thereon.

7. The apparatus of claim 1, said needle stem being manufactured from tungsten carbide.

8. The apparatus of claim 1, said first body member being manufactured from a first material and said second body member being manufactured from a second material, said first material being relatively softer than said second material.

9. The apparatus of claim 8, said first material being stainless steel and said second material being tungsten carbide with a nickel binder.

10. An injector apparatus for injecting a liquefied gas into containers at an angle to said containers in a high-speed filling operation, comprising:

a) a central longitudinal axis which is positioned at an angle to the central longitudinal axis of said containers;

b) a first intake line in fluid flow relation with a supply tank;

c) a chamber in fluid flow relation with said first intake line;

d) an injector valve located within said chamber, said injector valve comprising:

i) a needle stem having a tapered end portion with a rounded end; and ii) a valve body having a first body member and a second body member, said first body member having a substantially straight outflow line with a first diameter and an upper opening, and said second body member having an upper, funnel-shaped opening, a substantially straight outflow line with a second diameter, and a lower portion that is mounted within said upper opening of said first body member, iii) wherein said outflow line of said first body member is aligned with said outflow line of said second body member;

e) an adjustment device operatively connected to said valve seat for adjusting the position of said valve seat relative to said needle stem;

f) a solenoid operatively connected to said needle stem;

g) a biasing assembly adjacent to said second end of said needle stem biasing said needle stem toward said valve seat;

h) a heater comprising at least one heating element positioned adjacent to said outflow line;

i) an open operating state whereby said tapered end portion of said needle stem is positioned away from said valve seat, allowing said liquefied gas within said chamber to flow out of said outflow line of said second body member, said outflow line of said first body member, and into one of said containers; and j) a closed operating state whereby said tapered end portion of said needle stem is seated within said valve seat, blocking said liquefied gas within said chamber from entering said outflow line.

11. The apparatus of claim 10, said second diameter of said outflow line of said second body member being at least as large as said first diameter of said outflow line of said first body member.

12. The apparatus of claim 10, said second diameter of said outflow line of said second body member being larger than said first diameter of said outflow line of said first body member.

13. The apparatus of claim 10, said second body member of said valve body having a sharp circumferential edge at said valve seat.

14. The apparatus of claim 10, said second body member further comprising a flange portion that abuts an upper surface on said first body member.

15. The apparatus of claim 10, said needle stem being manufactured from stainless steel and having a titanium nitride coating thereon.

16. The apparatus of claim 10, said needle stem being manufactured from tungsten carbide.

17. The apparatus of claim 10, said first body member being manufactured from a first material and said second body member being manufactured from a second material, said first material being relatively softer than said second material.

18. The apparatus of claim 17, said first material being stainless steel and said second material being tungsten carbide with a nickel binder.

* * * * *